US007052110B2

(12) United States Patent
Jones et al.

(10) Patent No.: US 7,052,110 B2
(45) Date of Patent: May 30, 2006

(54) PRINT HEAD DRIVE

(75) Inventors: Michael E. Jones, West Linn, OR (US); David P. Platt, Sherwood, OR (US)

(73) Assignee: Xerox Corporation, Stamford, CT (US)

( * ) Notice: Subject to any disclaimer, the term of this patent is extended or adjusted under 35 U.S.C. 154(b) by 275 days.

(21) Appl. No.: 10/749,725

(22) Filed: Dec. 30, 2003

(65) Prior Publication Data

US 2005/0140724 A1 Jun. 30, 2005

(51) Int. Cl.
*B41J 23/00* (2006.01)
*B41J 2/01* (2006.01)

(52) U.S. Cl. ..... 347/37; 347/101; 347/104

(58) Field of Classification Search ..... 347/8, 347/101
See application file for complete search history.

(56) References Cited

U.S. PATENT DOCUMENTS 5,389,958 A 2/1995 Bui et al.
5,488,396 A 1/1996 Burke et al.
5,734,392 A 3/1998 Cornell
5,864,774 A 1/1999 Jones
5,867,189 A 2/1999 Whitlow et al.
5,871,292 A 2/1999 Johnson et al.
6,042,217 A 3/2000 Jones
6,059,397 A 5/2000 Jones
6,213,580 B1 4/2001 Segerstrom et al.
6,244,686 B1 6/2001 Jensen et al.
6,247,785 B1 6/2001 Jones et al.
6,260,963 B1 7/2001 Reistad et al.
6,585,368 B1 7/2003 Park
2002/0024547 A1 2/2002 Miyakoshi
2002/0149637 A1 10/2002 Miyakoshi et al.
2003/0058294 A1 3/2003 Butterfield et al.
2005/0151765 A1* 7/2005 Platt et al. ..... 347/8

* cited by examiner

*Primary Examiner*—Thinh Nguyen
(74) *Attorney, Agent, or Firm*—Fay, Sharpe, Fagan, Minnich & McKee, LLP

(57) ABSTRACT

A drive system (20) for driving a driven member (18), such as a print head of an offset printing system includes a motor (170) and a pivotable linkage (180) which allows relative pivoting between the driven member and the drive system. The pivotable linkage is operatively connected with the motor for advancing the driven member.

24 Claims, 14 Drawing Sheets

FIG. 14
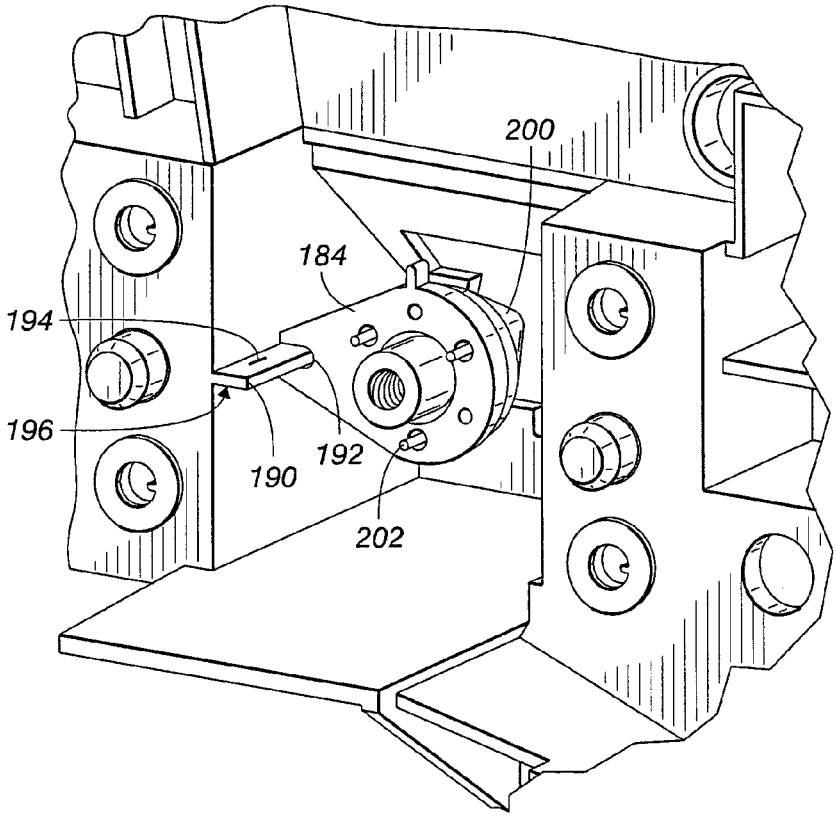
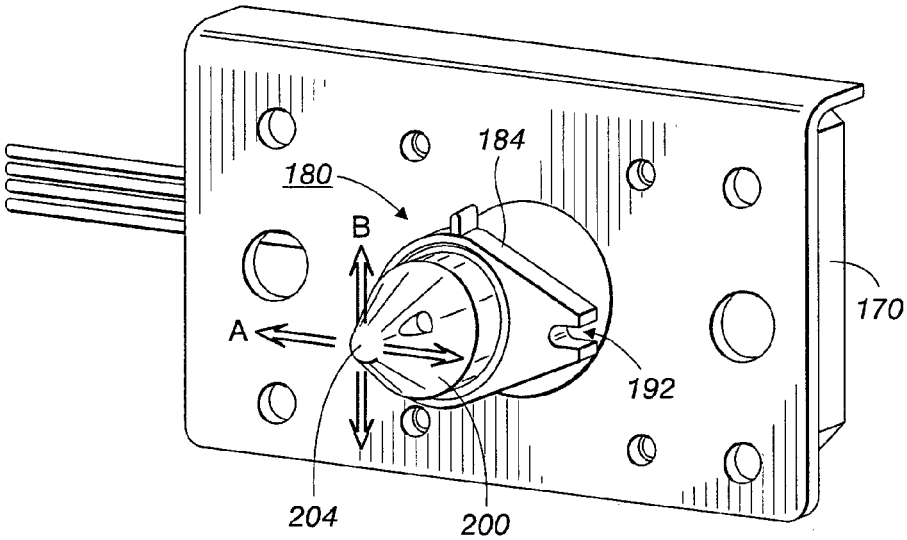
FIG. 15

PRINT HEAD DRIVE

BACKGROUND

The present exemplary embodiment relates generally to an apparatus and a method for driving a print head in a printing system and, more specifically, to a drive system which allows the print head to maintain alignment with a transfer surface with little or no adjustment during regular use. However, it is to be appreciated that the present exemplary embodiment is also amenable to other like applications.

Ink jet printing involves the delivery of droplets of ink from nozzles in a print head to form an image. The image is made up of a grid-like pattern of potential drop locations, commonly referred to as pixels. The resolution of the image is expressed by the number of ink drops or dots per inch (dpi), with common resolutions being 300 and 600 dpi.

Ink jet printing systems commonly utilize either direct printing or offset printing architecture. In a typical direct printing system, ink is ejected from jets in the print head directly onto a final receiving medium, such as a sheet of paper. In an offset printing system, the print head jets the ink onto an intermediate transfer surface, such as a liquid layer on a drum. The final receiving medium is then brought into contact with the intermediate transfer surface and the ink image is transferred and fused or fixed to the medium. In some direct and offset printing systems, the print head moves relative to the final receiving medium or the intermediate transfer surface in two dimensions as the print head jets or orifices are fired. Typically, the print head is translated along an X-axis while the final receiving medium/intermediate transfer surface is moved along a Y-axis. In this manner, the print head "scans" over the print medium and forms a dot-matrix image by selectively depositing ink drops at specific locations on the medium.

Printers of the offset type may employ a single print head which delivers ink droplets to a drum. The drum rotates multiple times during the formation of an image. Typically, the print head includes a jetstack or plate which defines multiple jets configured in a linear array to print a set of scan lines on the intermediate transfer surface with each drum rotation. With each rotation, X-axis translation of the print head causes the jets to be offset by one or more pixels, enabling the printer to create a solid fill image, continuous line, or the like, depending on the particular combinations of jets fired.

Precise placement of the scan lines is important to meet image resolution requirements and to avoid producing undesired printing artifacts, such as banding and streaking. Accordingly, the X-axis (print head translation) and Y-axis (drum rotation) motions are carefully coordinated with the firing of the jets to ensure proper scan line placement.

As the size of the desired image increases, the X-axis movement/head translation and/or Y-axis motion requirements become greater. One technique for printing larger-format images is disclosed in U.S. Pat. No. 5,734,393 for INTERLEAVED INTERLACED IMAGING, assigned to the assignee of the present patent. This application discloses a method for interleaving or stitching together multiple image portions to form a larger composite image. Each of the image portions is deposited with a separate X-axis translation of the print head. After the deposition of each image portion, the print head is moved without firing the jets to the start position for the next image portion. Adjacent image portions overlap and are interleaved at a seam to form the composite image. In this image deposition method, the relative position of each image portion is carefully controlled to avoid visible artifacts at the seam joining adjacent image portions.

Prior art ink jet printers have utilized various mechanisms to impart X-axis movement to a print head. An exemplary patent directed to an X-axis positioning mechanism is U.S. Pat. No. 5,488,396 for PRINTER PRINT HEAD POSITIONING APPARATUS AND METHOD (the '396 patent), assigned to the assignee of the present application. This patent discloses a motion mechanism comprising a stepper motor that is coupled by a metal band to a lever arm. Rotation of the lever arm imparts lateral X-axis motion to a positioning shaft that is attached to the print head. This mechanism translates each step of the stepper motor into one pixel of lateral X-axis movement of the print head. The amount of X-axis translation per step of the stepper motor is adjustable by an eccentrically mounted ball that is positionable on the lever arm.

An exemplary patent directed to an X-axis drive mechanism is U.S. Pat. No. 6,244,686 (the '686 patent) entitled PRINT HEAD DRIVE MECHANISM, and assigned to the assignee of the present application. The '686 patent discloses a motor coupled to a lead screw by gears. While the drive mechanism of the '396 patent provides highly accurate and repeatable movement of a print head, it is nevertheless subject to minor displacement errors arising from such factors as imbalances in stepper motor phase and thermal expansion of various components under changing operating temperatures. The motor is connected with the positioning shaft by multiple gears, each gear contributing to the difficulty in maintaining tolerances. When the positioning shaft is not axially aligned with the print head, this can lead to stresses in the drive system, leading to shortened expected lifetime. Additionally, the stresses developed may cause the print head to become misaligned with the transfer drum. These misalignments tend to be of less significance when the jetstack height is relatively small.

Periodically, such offset printers are recalibrated to compensate for minor displacements in the print head or drum. In ink jet printers with a short jet array height, e.g., of about 5 mm, or less, the most sensitive alignment parameter has generally been the distance between the jetstack and the drum. Alignment is accomplished by adjustment of the print head and print engine, typically by using adjustment screws. The print head is thus fixed at a preselected spaced distance from the drum, leaving a gap between the drum and the jetstack. However, the adjustment screws do not control movement in all directions so there remains a possibility for mismatches in alignment to occur.

The present exemplary embodiment contemplates a new and improved print head drive system and method which overcome the above-referenced problems and others.

BRIEF DESCRIPTION

In accordance with one aspect of the present exemplary embodiment, a drive system for driving a driven member is provided. The drive system includes a motor and a pivotable linkage which allows relative pivoting between the driven member and the drive system. The pivotable linkage is operatively connected with the motor for advancing the driven member.

The advantages and benefits of the present exemplary embodiment will become apparent to those of ordinary skill in the art upon reading and understanding the following detailed description of the preferred embodiments.

Still further advantages and benefits of the present exemplary embodiment will become apparent to those of ordinary skill in the art upon reading and understanding the following detailed description of the preferred embodiments.

BRIEF DESCRIPTION OF THE DRAWINGS

The exemplary embodiment may take form in various components and arrangements of components, and in various steps and arrangements of steps. The drawings are only for purposes of illustrating preferred embodiments and are not to be construed as limiting the exemplary embodiment.

FIG. 14 is an enlarged perspective view of a cone and nut assembly of FIG. 11 engaging the guide rib of FIG. 13;

FIG. 15 is an enlarged perspective view of the print head drive mechanism of FIG. 11 showing movement directions of the cone and nut assembly.

DETAILED DESCRIPTION

While the present invention will hereinafter be described in connection with its preferred embodiments and methods of use, it will be understood that it is not intended to limit the invention to these embodiments and method of use. On the contrary, the following description is intended to cover all alternatives, modifications, and equivalents, as may be included within the spirit and scope of the invention as defined by the appended claims.

Figure 1:
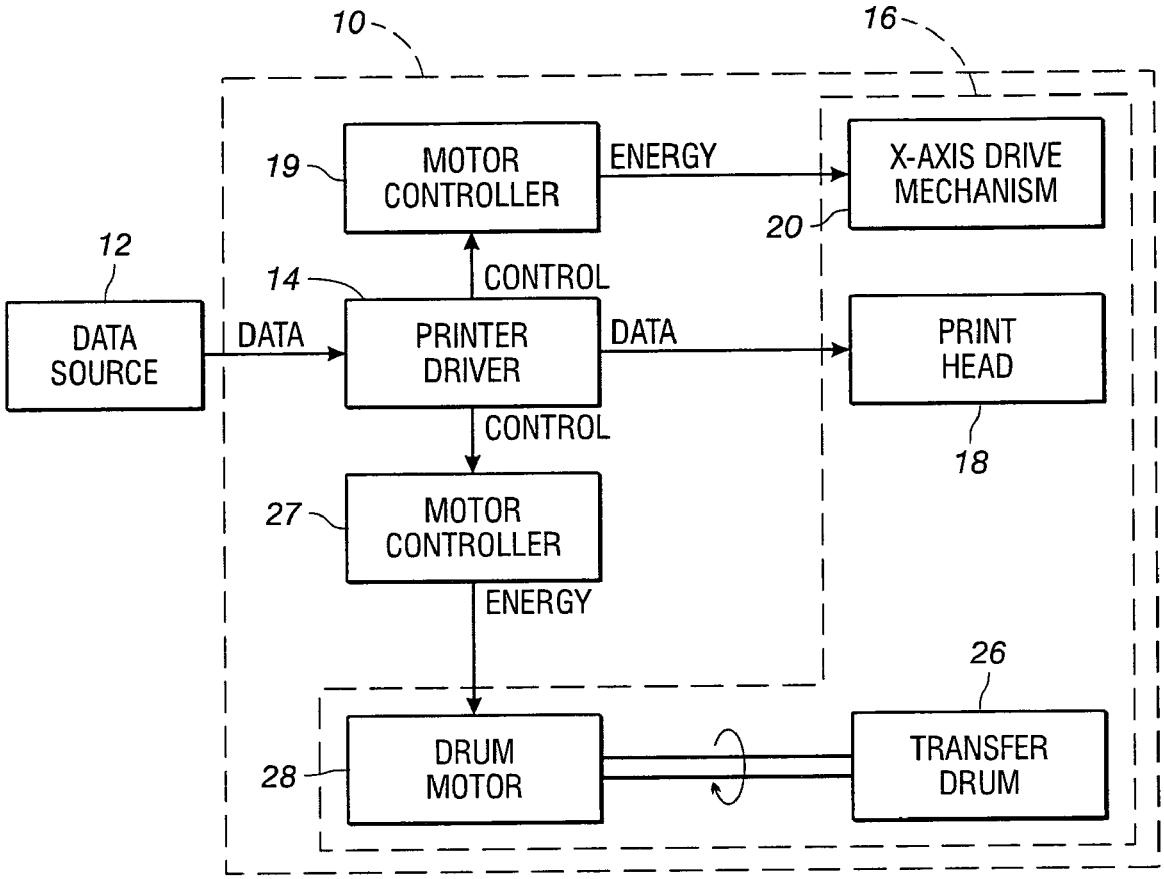
FIG. 1 is a simplified block diagram of an exemplary offset ink-jet printing apparatus that utilizes the alignment system of the present invention.

With reference to FIG. 1, an imaging system 10 is shown. The exemplary imaging system 10 is a printing apparatus which utilizes a single print head for performing an offset or indirect ink jet deposition method. Examples of this type of offset ink-jet printing apparatus is disclosed in U.S. Pat. No. 5,389,958 (the '958 patent) entitled IMAGING PROCESS, and U.S. Pat. No. 6,213,580 for an APPARATUS AND METHOD FOR ALIGNING PRINT HEADS (the '580 patent), which are assigned to the assignee of the present application. The '580 and '958 patents are hereby specifically incorporated by reference in pertinent part. It will be appreciated, however, that the present apparatus and method may also be employed with various other ink-jet printing devices which utilize different architectures, including multiple print head printing devices.

With continued reference to FIG. 1, the printing apparatus 10 receives imaging data from a data source 12. A printer driver 14 within the printer 10 processes the imaging data and controls the operation of a print engine 16. The printer driver 14 feeds formatted imaging data to a print head 18 of the print engine 16 and controls the movement of the print head by sending control data to a motor controller 19 that activates an X-axis drive mechanism 20. The printer driver 14 also controls the rotation of a transfer drum 26 by providing control data to a motor controller 27 that activates a drum motor 28.

Figure 2:
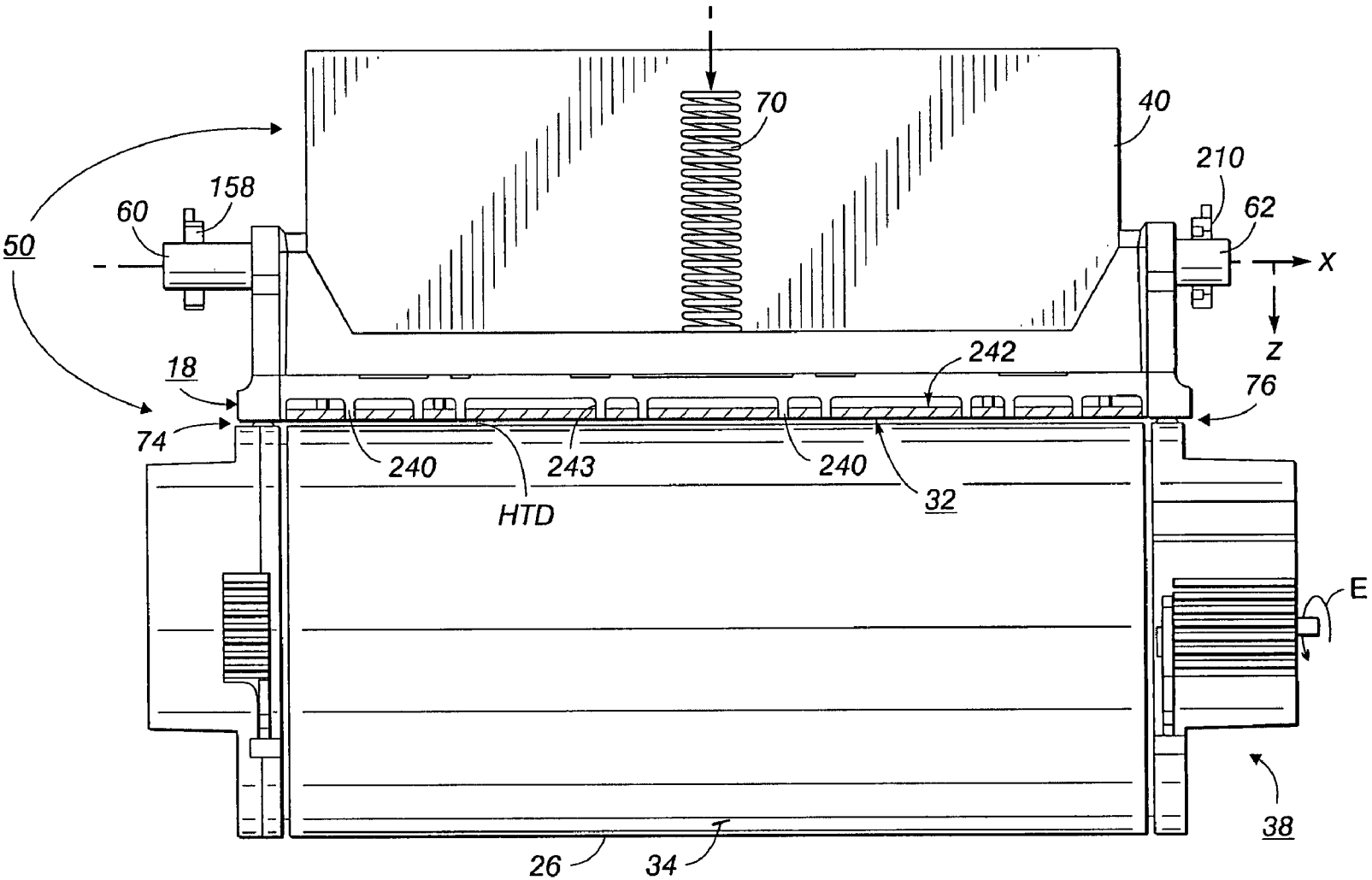
FIG. 2 is a top plan view of a drum assembly and print head of the printing apparatus of FIG. 1.
Figure 3:
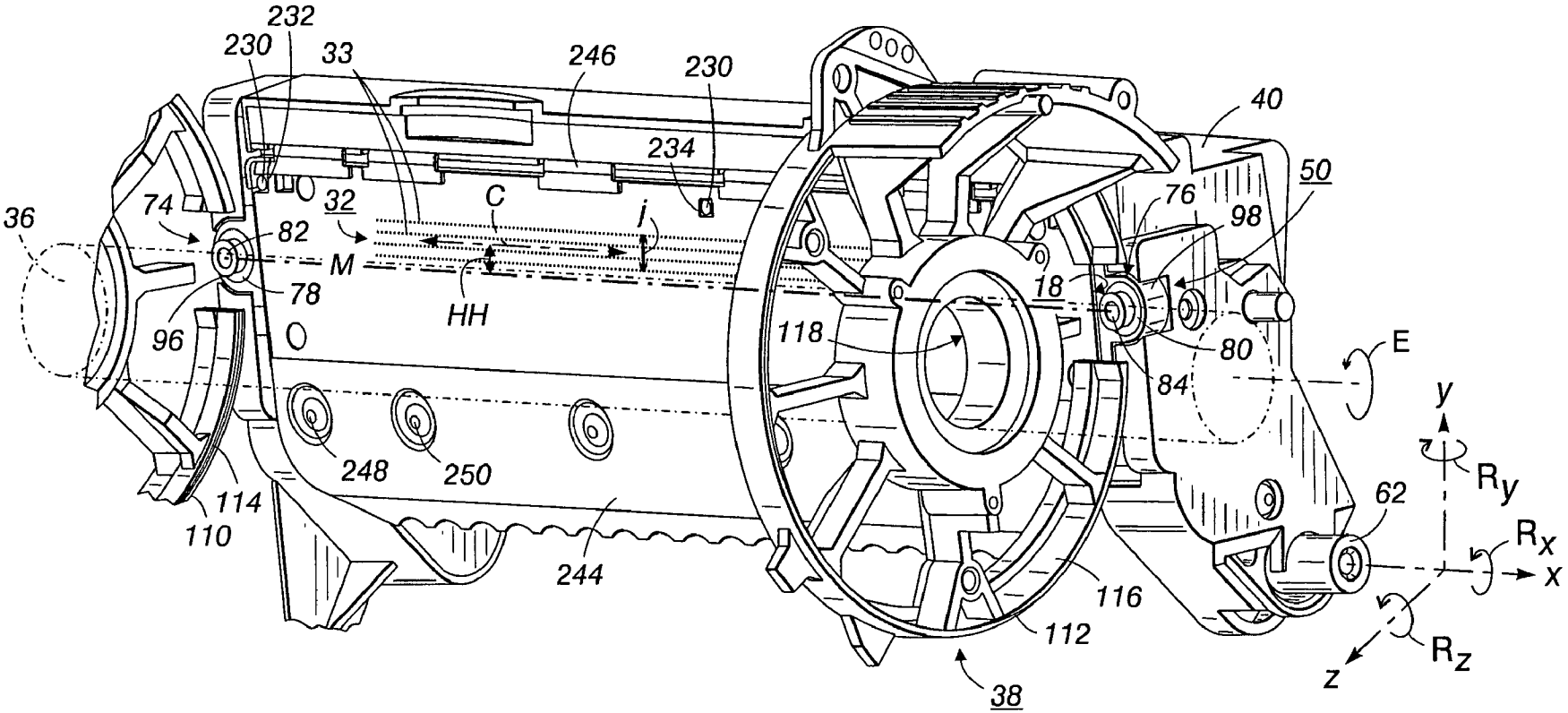
FIG. 3 is a perspective view, partially cut away of the drum assembly and print head of FIG. 2.

With reference also to FIG. 2, the print head 18 of the print engine 16 includes a jetstack 32 in the form of a perforated plate that extends parallel to the transfer drum 26. In operation, the print head 18 is moved parallel to the transfer drum 26 along an X-axis as the drum 26 is rotated and print head jets or nozzles 33 (FIG. 3) in the form of orifices in the jetstack 32 are fired. Rotation of the drum 26 creates motion in a Y-axis direction relative to the print head 18, as indicated by arrow Y (FIG. 3). Liquid or molten ink is ejected from the print head nozzles 33 onto an intermediate transfer surface 34 (FIG. 2), which forms an outer cylindrical surface of the drum 26.

As shown in FIG. 3, which shows a perspective view with the drum omitted for clarity, the drum 26 is mounted for rotation on a shaft 36 (shown in phantom). The shaft 36 and drum 26 are the moving parts of a drum assembly 38, the stationary parts of which will be described in greater detail below. The shaft 36 and associated drum 26 are rotated in the direction of action arrow E. In this manner, an ink image is deposited on an intermediate transfer layer (not shown). The intermediate transfer layer can be a liquid layer that is applied to the drum surface 34 with an applicator assembly (not shown), and may include, for example, water, fluorinated oils, surfactants, glycols, mineral oils, silicone oils, functional oils, and combinations thereof.

In one embodiment, the ink utilized in the printer 10 is initially in solid form and is then changed to a molten state by the application of heat energy. The molten ink is stored in a reservoir 40, mounted to the print head, and is delivered to the jets 33. The intermediate transfer surface 34 is maintained at a preselected temperature by a drum heater (not shown). On the intermediate transfer surface, the ink cools and partially solidifies to a malleable state.

One rotation of the transfer drum 26 and a simultaneous translation of the print head 18 along the X-axis while firing the ink jets 33 results in the deposition of an angled scan line on the intermediate transfer layer of the drum 26. It will be appreciated that one scan line has an approximate width of one pixel (one pixel width). In 300 dots per inch (dpi) (about 118 dots per cm) printing, for example, one pixel has a width of approximately 0.085 mm. Thus, the width of one 300 dpi scan line equals approximately 0.085 mm.

Figure 4:
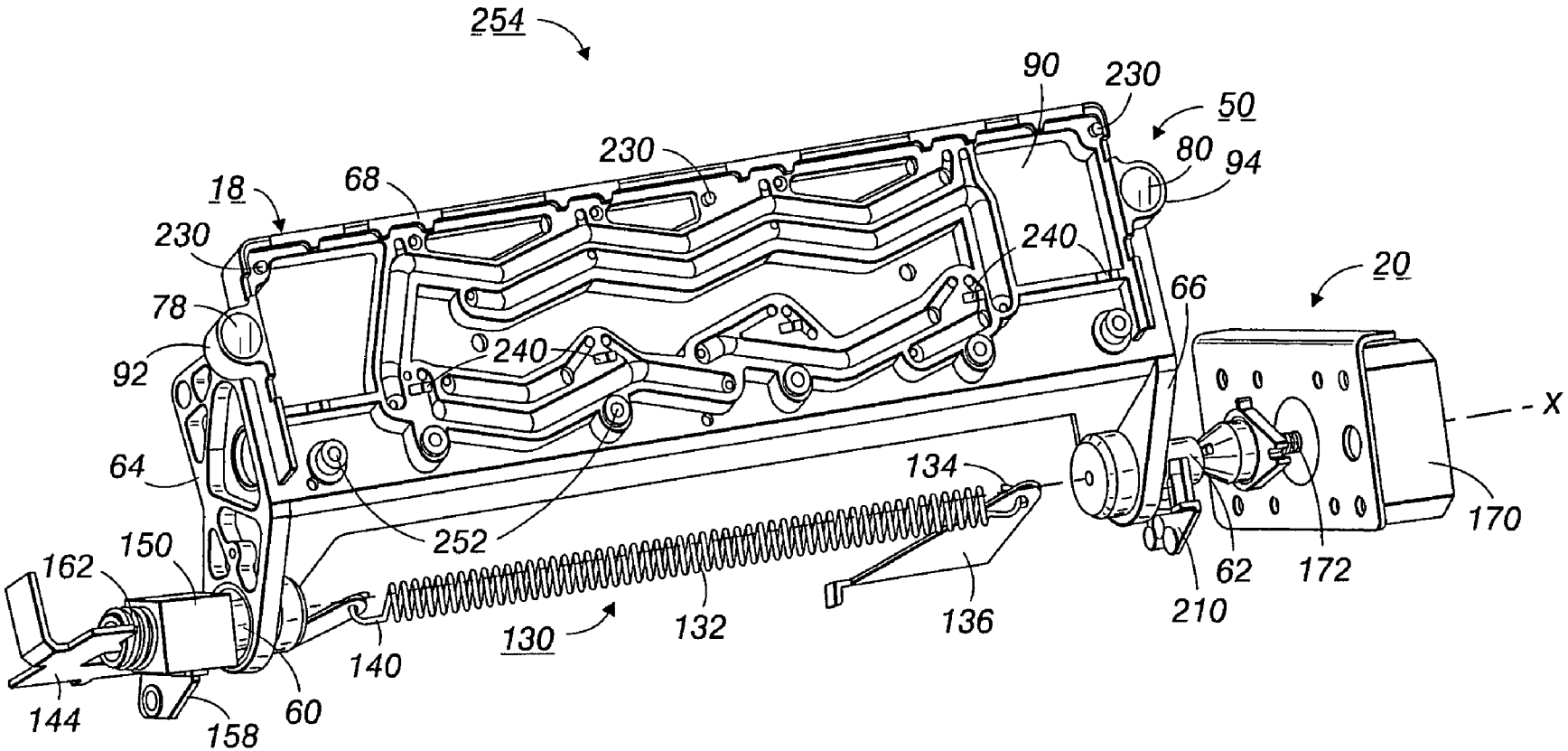
FIG. 4 is an enlarged perspective view of the print head of FIG. 2 and a print head drive mechanism.

With reference also to FIG. 4, an alignment system 50 maintains alignment of the print head jetstack 32, relative to the transfer surface 34 of the drum 26, to minimize unwanted relative movement between the jetstack and the drum during printing. The alignment system 50 thus minimizes unwanted movement (as opposed to the desired X-axis translation of the print head and rotation of the drum), which can result in undesired printing artifacts, such as banding and streaking.

As illustrated in FIG. 3, an object which is free to move is space has six degrees of freedom, illustrated by perpendicular axes X, Y, Z and rotational axes $R_x$, $R_y$, $R_z$. To constrain the object against movement, all six degrees of freedom need to be controlled. The present alignment system 50 acts to constrain the jetstack 32 against unwanted movement in all six degrees of freedom, thereby facilitating the use of a larger jet array height j (the vertical height between upper and lowermost jets 33) than has been possible with prior systems. The alignment system 50 uses a linkage of components, which will be described in greater detail below. The linkage provides three contact points to define a plane and a fourth point to constrain the print head against rotation. In this way, the print head, and hence the jetstack, are accurately positioned without the need for recalibration once the printer leaves the factory.

Print quality has been found to be sensitive to three alignment tolerance parameters, as follows:

1. The print head-to-drum distance (HTD), which is the distance across the gap between the jetstack 32 and the drum 26 in the Z-axis in the region of the jets (FIG. 2, not to scale). If there is a difference in HTD between left and right sides of the printer, this is known as HTD skew or yaw. In conventional printers, this distance is measured and is an important part of a recalibration process.
2. The head height (HH) is the distance between the centerline C of the jet array and the drum midline M in the Y-axis (FIG. 3, not to scale). Since the drum is cylindrical, relative movement in the Y-axis or rotation about the Z-axis (referred to as pitch) also adds to the head height. This combination of head height variation and pitch is referred to as hilt.
3. The head roll is the difference in head height between the right and left sides of the print head (roll about the Z-axis).

The alignment system 50 allows each of these alignment parameters to be controlled to maintain print quality, without the need for recalibration. It will be appreciated that the terms "left" and "right" refer to the arrangement of the print head 18 and drum 26 illustrated in FIGS. 2 and 3.

Figure 5:
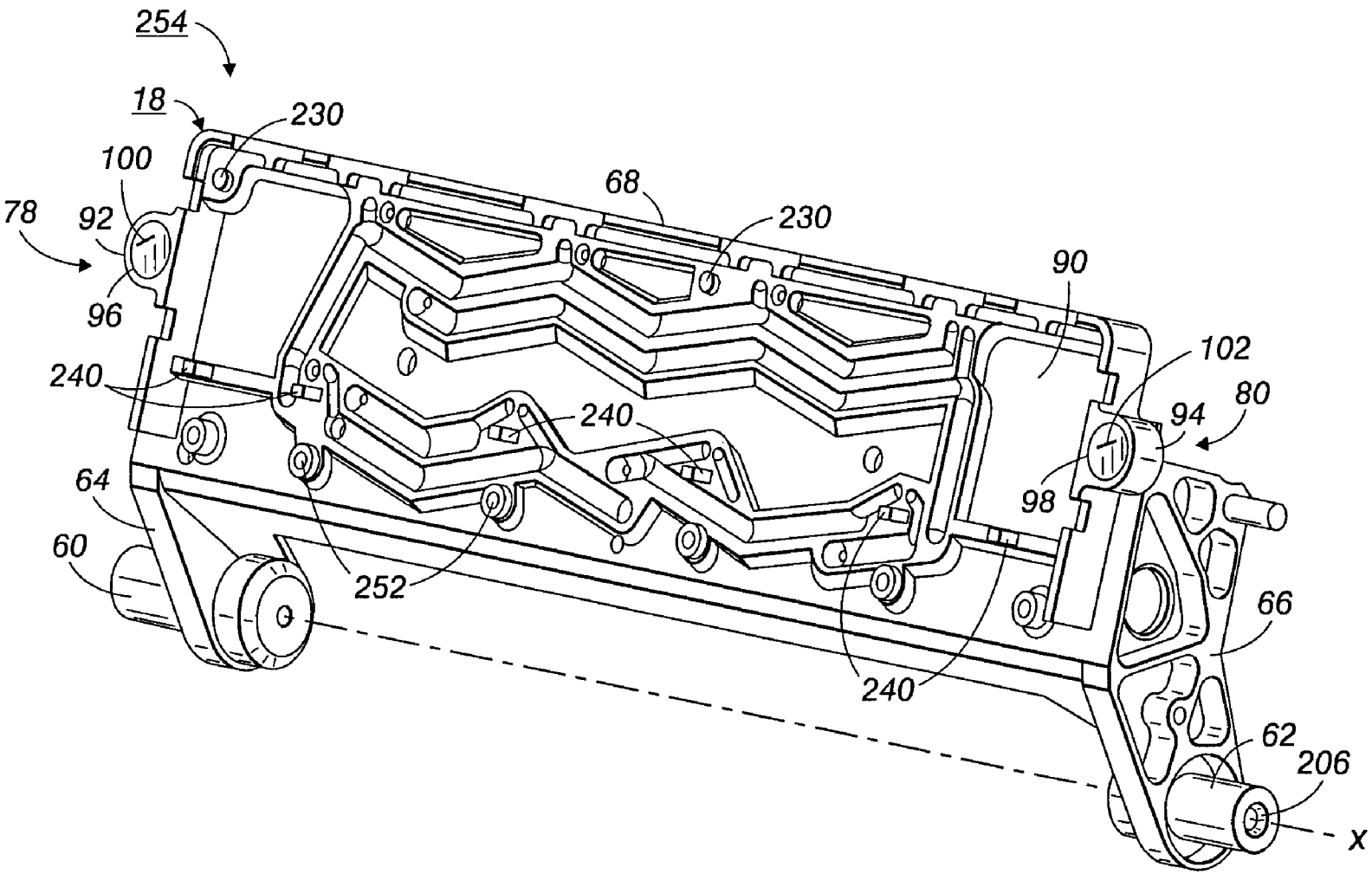
FIG. 5 is an enlarged perspective view of the print head of FIG. 4.

With reference to FIGS. 4 and 5, which show one embodiment of a print head 18 with the jetstack removed for clarity, the print head 18 is mounted to left and right stub shafts or journal pins 60, 62 by left and right mounting towers 64, 66, respectively, at opposed ends of the print head. As explained in more detail below, the print head drive mechanism 20 translates the right stub shaft 62 along the X-axis and thus the coupled print head 18 moves in a direction parallel to the X-axis. It will be appreciated that the drive mechanism 20 could, alternatively, translate the left stub shaft 60, if its position were changed. The X-axis is defined as being collinear with an axis through the stub shafts 60, 62 (FIG. 5).

An upper end 68 of the print head 18 can be biased about rotational axis $R_x$ in a direction towards the drum 26, by a biasing member or members, such as one or more head tilt springs 70. A single head tilt spring 70 is illustrated in FIG. 2, between left and right mounting towers 64, 66. The print head 18 makes contact with the drum assembly 38 at first and second contact points 74, 76, adjacent left and right sides of the print head respectively. The contact points 74, 76 are defined by first and second contacting members 78, 80 (FIG. 4), in the form of hard stops, carried by the print head 18, and corresponding first and second receiving members 82, 84 in the form of buttons, carried by the drum (FIG. 3). It will be appreciated that in FIG. 3, part of the drum assembly is shown cut away, so that the buttons 82, 84 are visible. Additionally, or alternatively, the center of gravity of the reservoir 40 and print head 18, being forward (closer to the drum) than the shafts 60, 62, helps to keep the hard stops in contact with the buttons.

As shown in FIG. 5, the print head 18 includes a front reservoir plate 90, formed from a rigid material, such as aluminum, which is integrally formed with or otherwise rigidly mounted to the left and right mounting towers 64, 66. The front reservoir plate 90 includes generally cylindrical extension members 92, 94, which extend from left and right sides of the reservoir plate 90, respectively, parallel with the X-axis. The extension members are integrally formed with or otherwise rigidly connected with the front reservoir plate 90. Cylindrical blocks 96, 98, formed from stainless steel or other hardened material, are mounted within the extension members 92, 94, respectively. A front face 100, 102 of each of the blocks 96, 98 defines a generally planar contacting surface of the respective hard stop 78, 80.

While in the illustrated embodiment, the hard stops 78, 80 are carried by the reservoir plate 90, in an alternative embodiment, the hard stops are carried by the jetstack 32. In yet another embodiment, the positions of the hard tops and buttons are reversed, with the hard stops being carried by the drum assembly and the buttons being carried by the print head.

As illustrated in FIG. 3, which shows part of the drum assembly 38 cut away for clarity, the buttons 82, 84 are mounted to a stationary part of the drum assembly, by generally cylindrical labyrinth seals 110, 112. The buttons can be formed from a resilient plastic or other suitable material which undergoes little or no deformation on contact with the hard stops 78, 80 and which provides a low friction contact with the steel material of the hard stops. The buttons 82, 84 may each have a convex, spherical tip, which provides a single point of contact with the respective hard stop 78, 80, while allowing for any misalignment between the button and the hard stop. As the print head 18 translates during printing, the hard stops 78, 80 make sliding contact with the buttons 82, 84, over the length of travel of the print head. Thus, for contact to be maintained throughout the printing operation, the X-directional width of the contacting surfaces 100, 102 of each of the hard stops is greater than a length of travel of the print head during translation.

Figure 6:
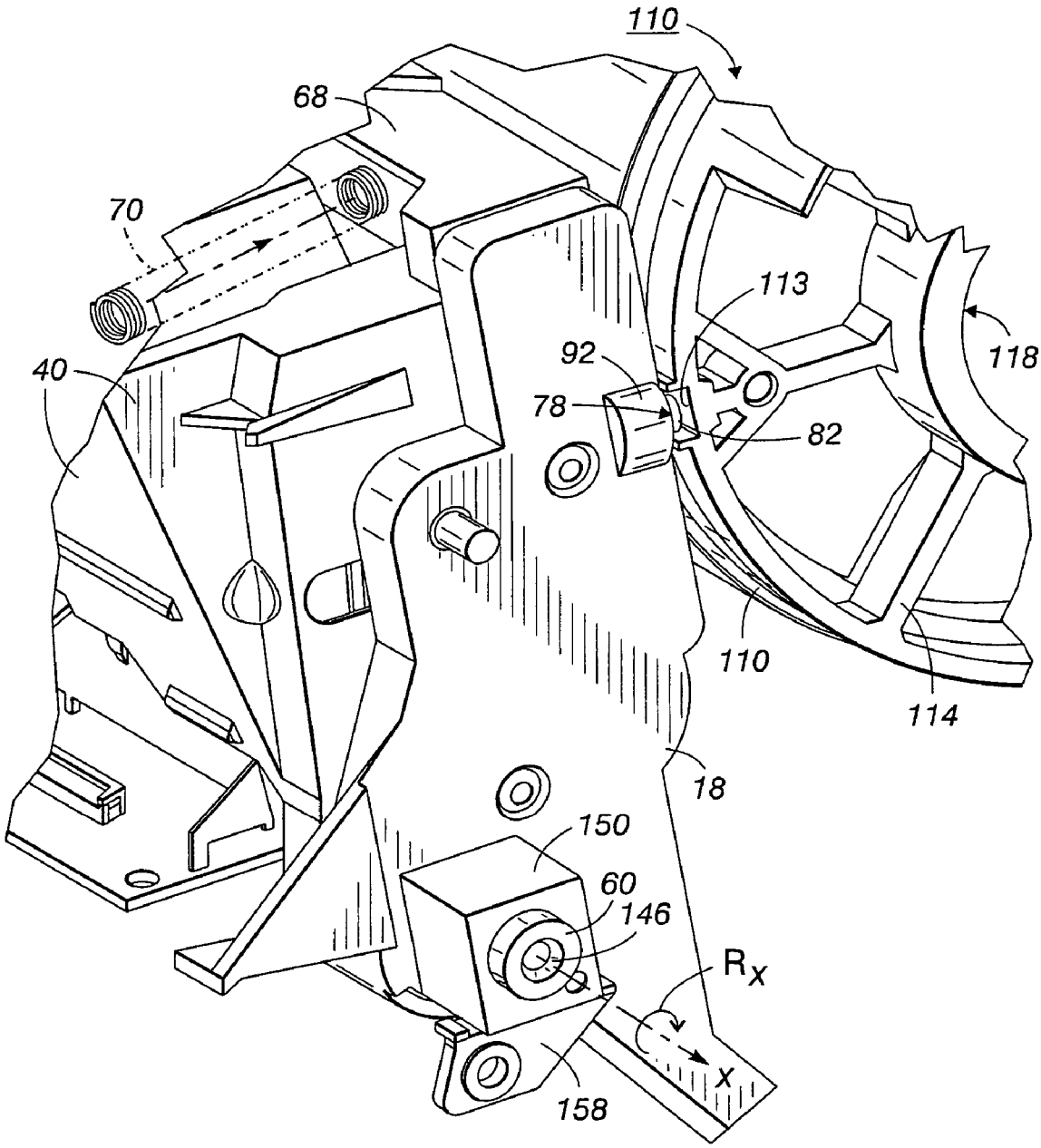
FIG. 6 is a greatly enlarged perspective view of a portion of the print head and drum assembly of FIG. 3, showing a point of contact between the print head and drum assembly.

As shown in FIG. 6, which shows the left hand button 82, the buttons are mounted within suitably positioned sockets 113 in peripheral portions 110, 112 of left and right stationary frames 114, 116. These frames 114, 116, also referred to as "labyrinth seals" carry the bearings for the drum shaft 36 (illustrated in phantom in FIG. 3) via a central aperture 118 formed therein. The sockets 113 extend into the frames 114, 116 to which the buttons are rigidly mounted. The frames or "labyrinth seals" as implemented are formed from cast aluminum. Alternate materials are considered. The head tilt spring 70 biases the upper end of the print head 18 such that the hard stops 78, 80 remain in contact with the buttons 82, 84, as shown in FIG. 6.

Figure 7:
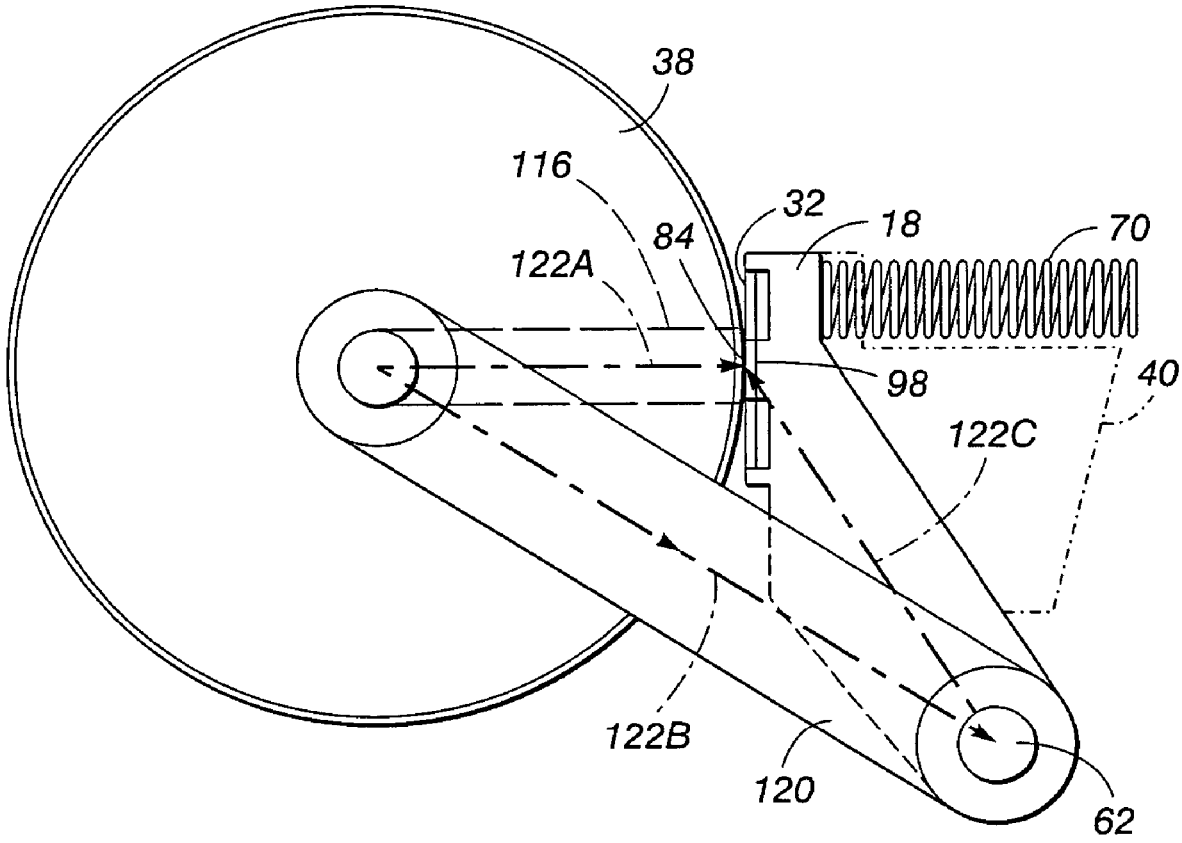
FIG. 7 is a schematic view of a linkage between the drum and print head of FIG. 2.

As illustrated schematically in FIG. 7, the drum assembly 38 is rigidly mounted to a chassis 120 of the printer. Specifically, the drum labyrinth seals 114, 116 are mounted by bolts, screws, or the like to the chassis 120. The chassis 120 may be formed from metal, hard plastic, or other relatively rigid material. The chassis 120 forms a part of a three part linkage 122 between the drum labyrinth seals 114, 116 (and hence the buttons) and the hard stops, via the print head drive mechanism 20 and right stub shaft 62, which constrains the movement of the print head. The linkage 122 includes a first linkage portion 122A, which links the buttons 82, 84 to the labyrinth seals 114, 116, a second linkage portion 122B, which comprises the chassis 120 and links the labyrinth seals with the print head drive mechanism 20, and a third portion 122C, which links the print head drive mechanism 20 with the hard stops 78, 80. In this way, two contact points in a plane are defined at 74, 76 (FIG. 2), with a third contact point in the plane defined by the right side x-axis stub shaft 62. The stub shaft 62 is constrained in the Y-axis and Z-axis, as will be explained in greater detail below.

With reference once more to FIG. 4, the left stub shaft 60 is biased along the X-axis, in the direction of the print head drive mechanism 20, by a biasing assembly 130. The biasing assembly 130 includes a bias spring 132, which in the illustrated embodiment, is aligned with the X-axis (i.e., coaxial with the stub shafts 60, 62), as far as tolerances reasonably permit. This alignment of the bias spring 132 with the X-axis serves to minimize any unwanted rotation of the print head 18 away from the drum 24 about the axes $R_y$ and $R_z$. The bias spring 132 serves to provide a constant bias force on the print head drive mechanism 20. The length of the bias spring 132 allows it to have a low spring rate and to provide a nearly constant force across the range of imaging motion, which in one embodiment, is approximately 4 mm.

An end 134 of the bias spring 132 closest to the drive mechanism 20 is mounted to the chassis 120 via a flange 136, thus fixing the position of the right hand end 134 of the biasing assembly 130, relative to the linkage 122.

Figure 8:
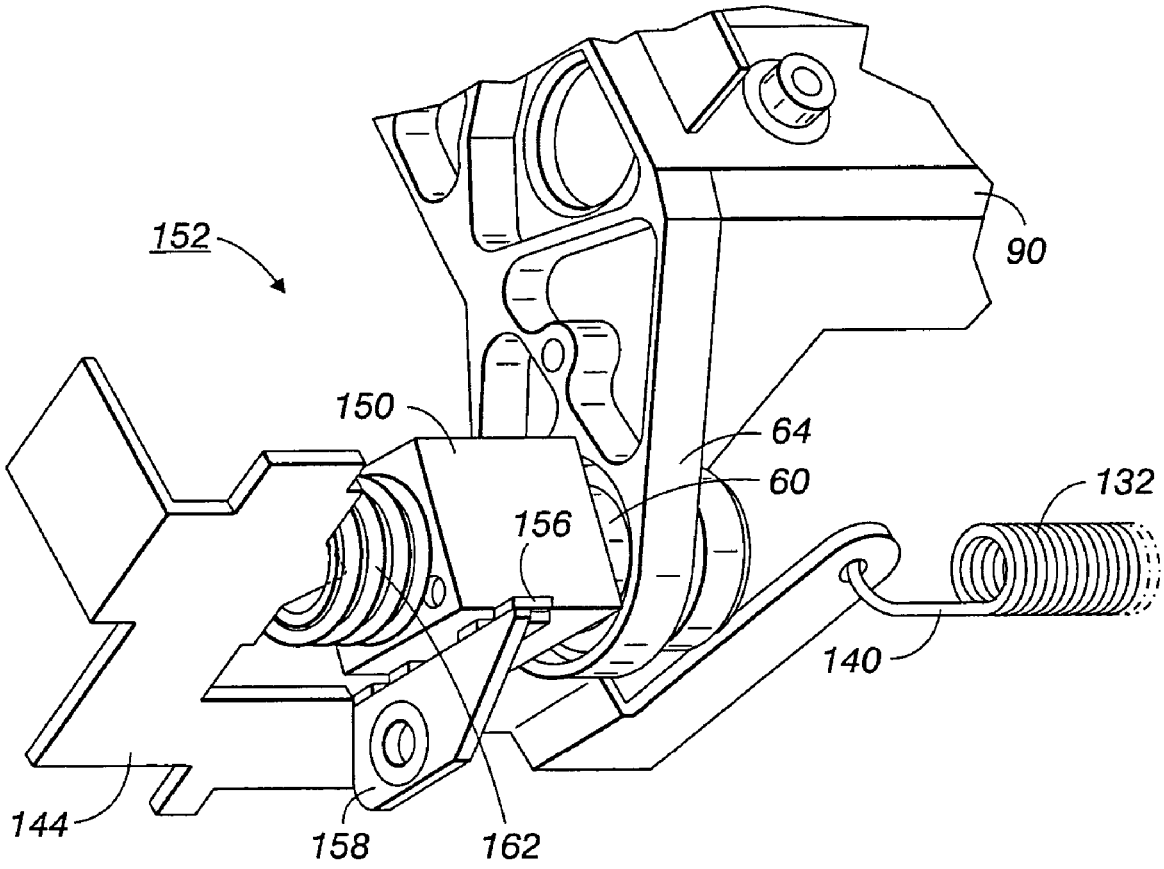
FIG. 8 is a greatly enlarged perspective view of a left hand end of the print head of FIG. 2 with a biasing assembly.
Figure 9:
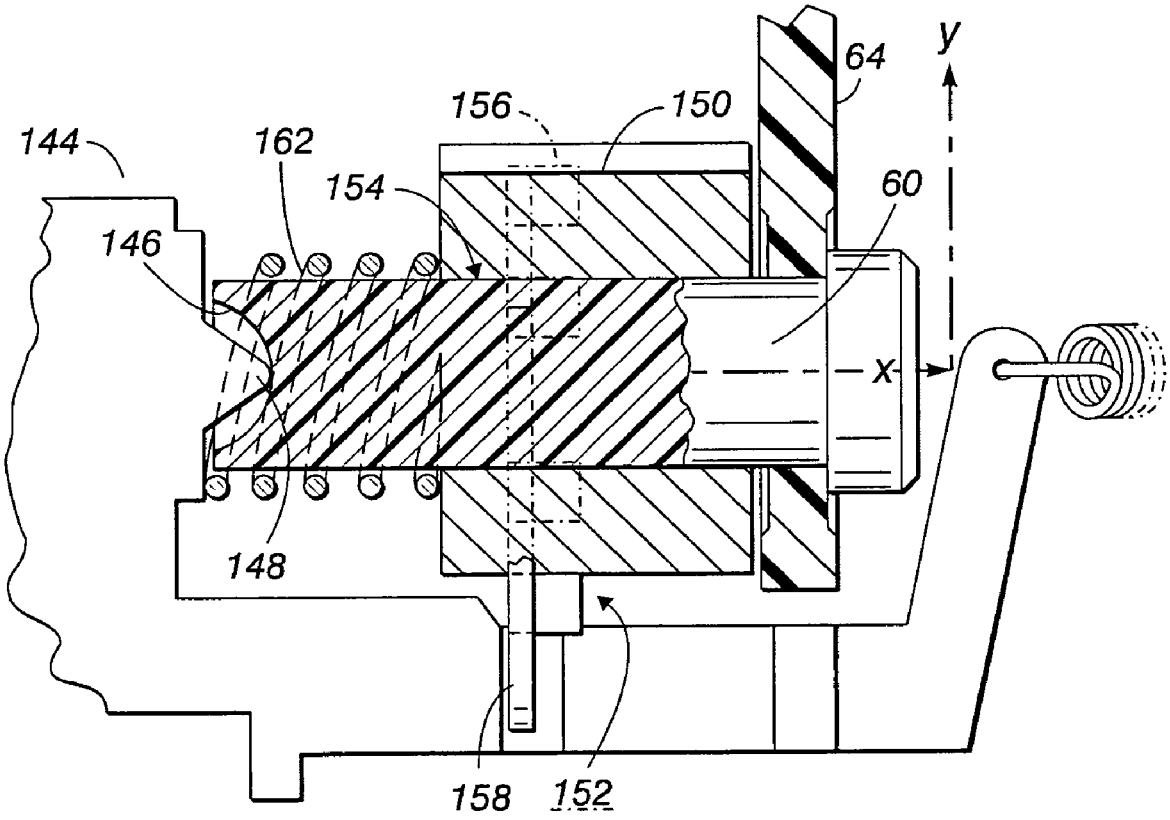
FIG. 9 is a sectional view of the left hand end of the print head of and part of the biasing assembly of FIG. 8.

As shown in FIG. 8, a left hand end 140 of the bias spring 132, furthest from the drive mechanism 20, is mounted to a right hand end of a hook-shaped retaining member 144. The hook-shaped retaining member 144 is configured to pass below a lower end of the left mounting tower 64 and engage a distal end of the left stub shaft 60, thereby maintaining the axial alignment of the bias spring 132. Specifically, as illustrated in FIG. 9, the distal end of the left stub shaft 60 defines a concave socket 146 with its midpoint aligned with the X-axis. The hook 144 defines an inwardly extending protrusion 148, which is seated in the socket 146, allowing a small amount of relative movement between the hook and the stub shaft toward the z-axis and/or y-axis to compensate for any slight misalignment between the chassis and the stub shaft 60. The hook 144 and protrusion 148 are removable from the socket 146 for repair or replacement of the print head 18. The tension in the bias spring 132 in the X-axis direction maintains the X-axis alignment of the hook and the stub shaft 60.

In an alternative embodiment, the left and right stub shafts form ends of a single shaft which connects the left and right towers 64, 66. In this embodiment, the bias spring 132 can be wound around a portion of the shaft which extends between the towers to minimize misalignment with the X-axis.

A roll block 150 is carried by the left stub shaft 60. The roll block defines a plurality of bearing faces 152, four in the illustrated embodiment, and a generally axial bore 154, which snugly receives the stub shaft 60 therethrough, and within which the stub shaft is free to rotate. One of the bearing faces 152 makes sliding contact with an upper flat surface 156 of a left hand X-axis bearing 158, which is rigidly mounted to the chassis 120. The weight of the print head 18 is sufficient to provide a downward force on the roll block 150 in the Y-axis direction, keeping the roll block 150 in contact with the left bearing 158. The bore 154 may be asymmetrically positioned, relative to the X-axis, thus providing each face with a slightly different distance from the X-axis, which may vary, for example, by a few micrometers (e.g., 50 μm). This allows slight variations in the alignment to be accommodated. The block 150 can be rotated, after the print head 18 has been installed in the printer, such that the face 152 which provides the best alignment in the Y-axis is in contact with the left bearing 158. Specifically, the asymmetry of the bore 154 allows the left stub shaft 60 to be raised or lowered by selection of the side 152 of the roll block that is placed against the left bearing 158. The flat surface 156 of the bearing allows the block to slide relative to the bearing, for right to left image motion, as well as front to back sliding (Z-direction), so that the print head to drum alignment system 50 is not overly constrained.

A force spring 162 is positioned on the stub shaft 60, intermediate the roll block 150 and the left hand end of the hook 144. The force spring 162 biases the block 150 against axial movement along the stub shaft 60. The force provided by the force spring 162 is less than that provided by the bias spring 132. During right to left X-axis translation of the print head 18, the increasing tension in the bias spring 132 maintains X-axis alignment of the stub shaft 60 and the hook 144. When the tension is reduced, as in translation of the print head in the left to right direction, the force spring 162 compensates for any tendency of the block to slip along the stub shaft in the right to left direction by providing a force which exceeds the friction force between the upper surface 156 of the left bearing 158 and the bearing face 152 of the block. In this way, contact is maintained between the right end of the roll block and the left mounting tower 64. In doing so, it assures sliding between the roll block 150 and the left bearing 158, rather than between the roll block and the left stub shaft 60. This helps to maintain constant and predictable forces which assist in minimizing positioning errors.

Figure 10:
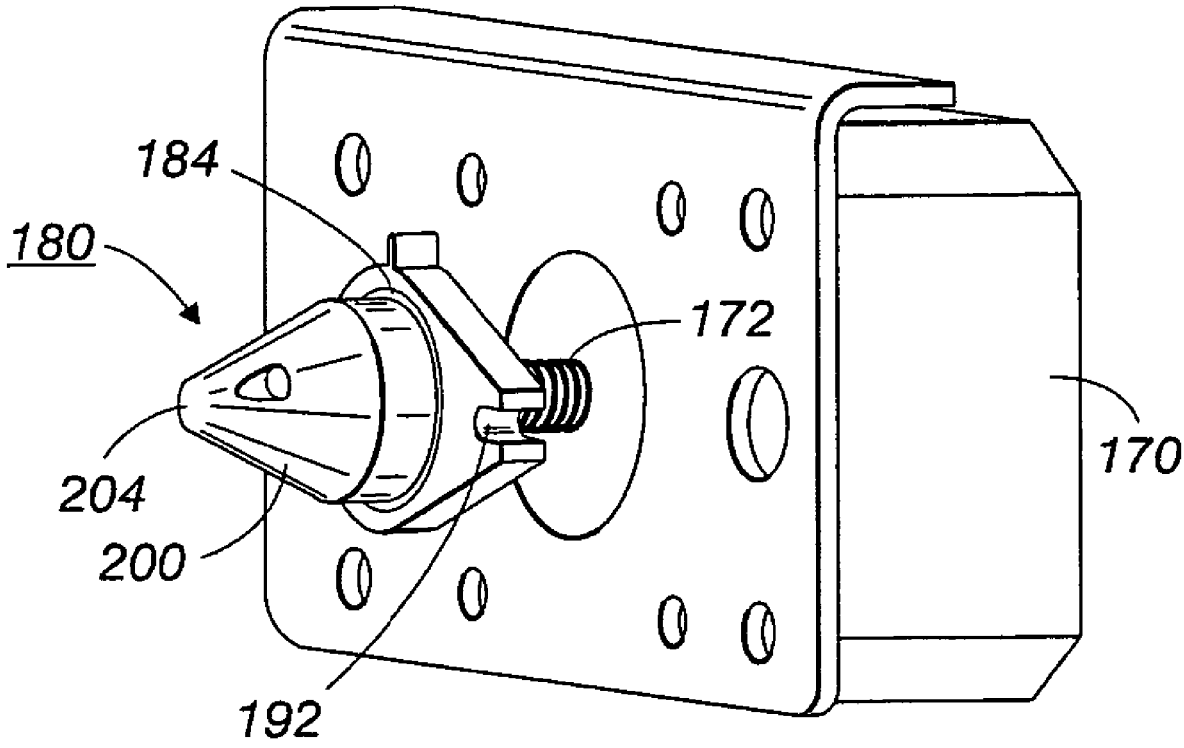
FIG. 10 is an enlarged perspective view of the print head drive mechanism of FIG. 4.
Figure 11:
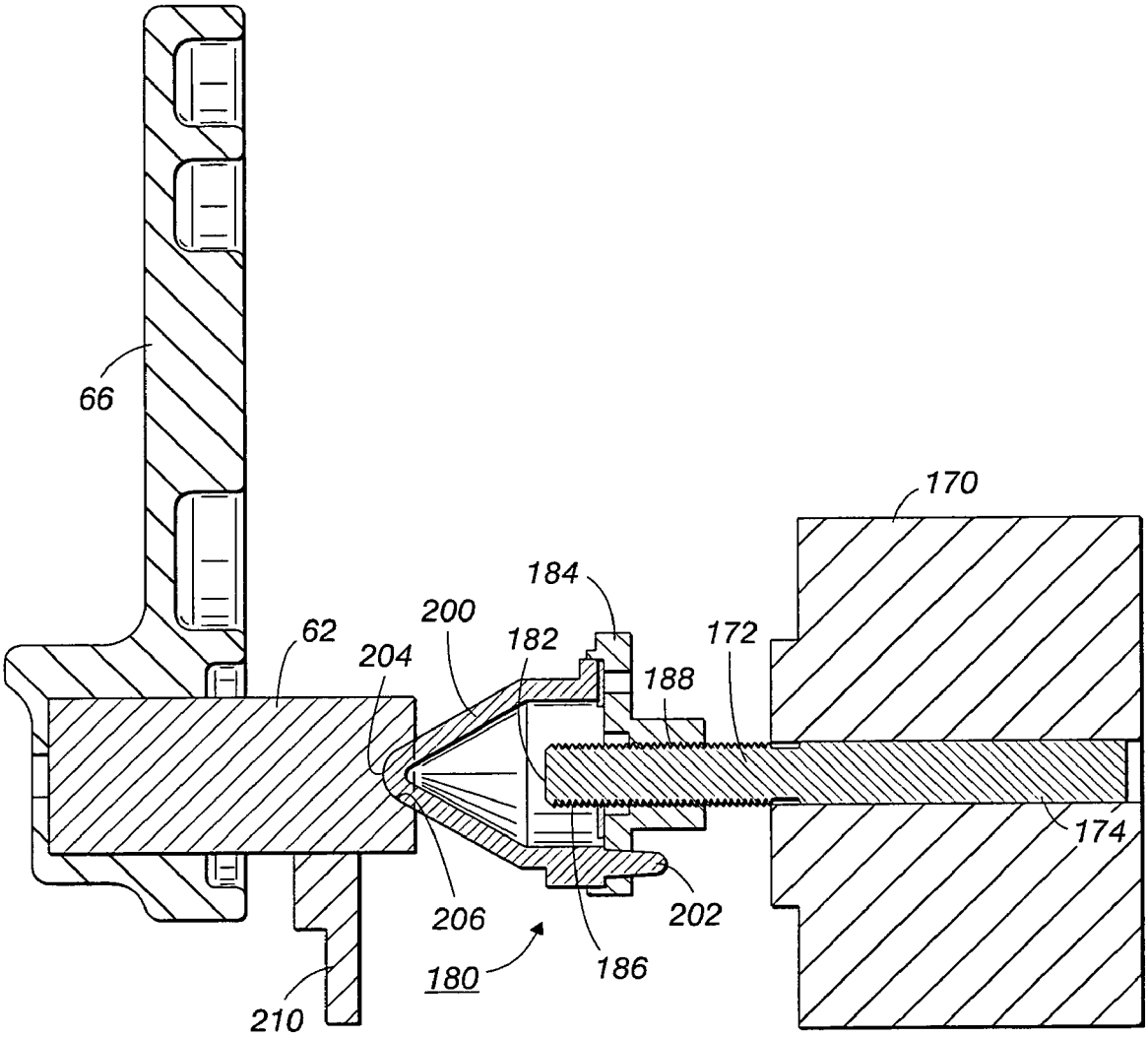
FIG. 11 is a side sectional view of the of the print head drive mechanism of FIG. 10.

With reference once more to FIG. 4, and reference also to FIGS. 10 and 11, the print head drive mechanism 20 includes a drive motor 170, such as a stepper motor, which is operatively connected with a lead screw 172. In the illustrated embodiment, the drive motor 170 is directly coupled with a first end 174 of the lead screw 172, without any intermediate eccentric gears, so that the motor and lead screw are aligned as close to the X-axis as reasonable tolerances permit. In this way, any tendency for the motor to impart non axial motion to the lead screw is minimized. Additionally, the direct coupling reduces the number of parts in the print head drive mechanism 20, and the stacked tolerances which this can entail.

In one embodiment, the stepper motor 170 has about 200 steps per revolution and is driven to provide 128 microsteps per whole step. The lead screw can have a pitch of about 18.75 turns per inch (TPI). This provides an addressable resolution of about 0.053 μm.

In an alternative embodiment (not shown), a motor is coupled to a lead screw by gears as is disclosed, for example, in U.S. Pat. No. 6,244,686 (the '686 patent), which is hereby specifically incorporated by reference in pertinent part.

Figure 13:
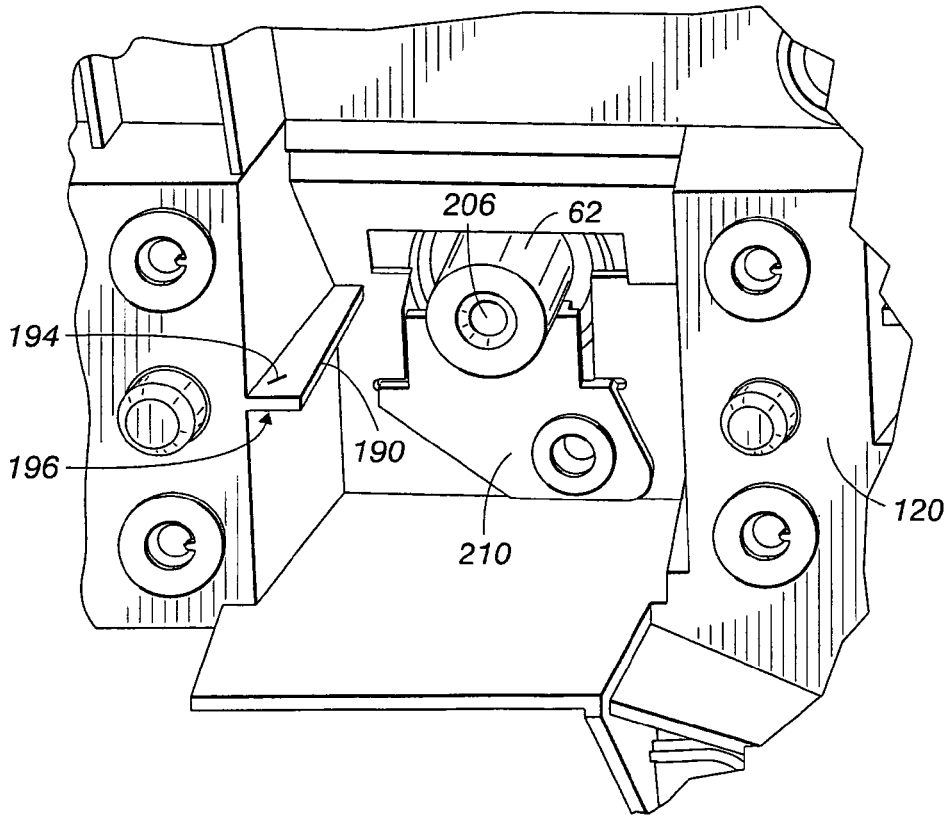
FIG. 13 is an enlarged perspective view of the right hand stub shaft of the print head and a guide rib of the print head drive mechanism of FIG. 10.

With continued reference to FIGS. 10 and 11, the lead screw 172 carries drive member 180, such as a nut and cone assembly, at a distal end 182 thereof. The nut and cone assembly 180 converts the rotational movement of the lead screw 172 into axial movement in the X-direction. Specifically, the assembly 180 includes an internally threaded nut portion 184, within which the lead screw rotates. Threads 186 of the lead screw engage the internal threads 188 of the nut portion 184. The nut portion 184 is constrained against rotational movement by a guide member or anti rotation device 190, such as a guide rib, as illustrated in FIGS. 13 and 14. The guide rib 190 extends generally parallel with the X-axis and can be mounted to a portion of the chassis 120. The nut portion 184 includes a lateral groove or slot 192 (FIG. 14), which receives the rib 190. During axial translation of the print head, rotation of the lead screw 172 causes the nut and cone assembly 180 to advance, while the nut portion 184 slides along the rib 190. The groove 192 maintains contact with one of the upper and lower horizontal surfaces 194, 196 of the rib during translation. In the illustrated embodiment, the groove 192 is slightly wider, in the Y-direction, than the rib 190, such that there is a small amount of rotational play permitted between the groove and the rib. So that this limited amount of play does not affect the drum to print head alignment, the printing can be carried out only in one axial direction, which may be in the right to left direction. In this way, the groove 192 always engages the same face of the rib 192 during printing.

It will be appreciated that the locations of the groove and guide rib may be reversed, by placing the groove on the chassis and a rib on the nut and cone assembly. Other means for limiting rotation of the nut and cone assembly 180 are also contemplated.

With reference once more to FIG. 11, the nut and cone assembly 180 further includes a cone portion 200, which for ease of manufacture, may be formed separately from the nut portion 184 and welded or otherwise fixedly attached thereto at a right hand end of the cone portion by means of pins 202. The cone portion 200 is generally conical in shape with a tip 204 at its distal end, which may be semispherical, as illustrated, although parabolic or elliptically curved tips are also contemplated. The tip 204 makes contact with the right stub shaft 62. Specifically, the right stub shaft 62 defines a concave socket 206, similar to socket 146 of the left stub shaft 60. The midpoint of the socket 206 is aligned with the X-axis. The socket is sized to receive the tip 204 therein and allow relative pivoting between the stub shaft 62 and the cone portion 200.

Although the lead screw 172 is nominally aligned with the X-axis, slight variations in alignment inevitably occur, either during assembly or in subsequent use of the printer. The flexible coupling created by the contacting of the right stub shaft 62 with the cone portion 200 allows these small variations to be accommodated by allowing the cone and nut assembly to pivot, relative to the right stub shaft. As will be appreciated, the bias spring 132 provides a biasing force in the general direction of the motor 170, which maintains sufficient contact between the tip 204 and the journal socket 206 to avoid misalignment of the print head during printing.

Figure 12:
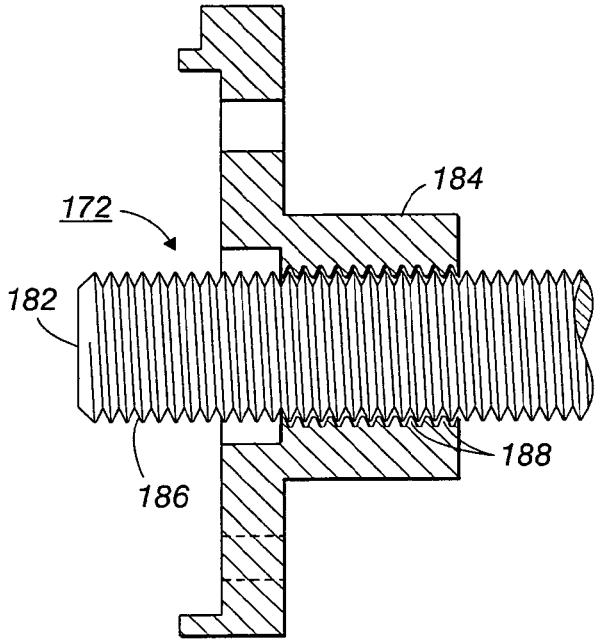
FIG. 12 is an enlarged side view of the lead screw and nut portion of the drive member of FIG. 11.

The nut and cone assembly 180 accommodates any residual misalignment of the lead screw 172 with the print head 18 due to tolerances of the components. Additionally, the assembly 180 accommodates run out of the nut cone assembly (variations along the threaded portion of the nut cone assembly which engage different portions of the lead screw during translation) which cause changes in alignment during translation of the print head. To allow the nut and cone assembly 180 to gimbal at both ends, the threads 188 of the nut portion 184 have a slightly wider diameter than the diameter of the lead screw threads 186, as illustrated in FIG. 12. This allows the nut and cone assembly to have a small amount of play relative to the lead screw 172. In this way, the nut and cone assembly 180 can pivot slightly in Y and/or Z directions, relative to the lead screw, to accommodate slight misalignment of the lead screw. Arrows A, B shown in FIG. 15 illustrate how the cone tip 204 can move, relative to the lead screw 172. For example, if the lead screw is slightly lower than the X-axis, the tip 204 of the nut and cone assembly will pivot slightly upward, and the nut portion will move accordingly.

It will be appreciated that the nut and cone assembly could alternatively define a concave distal surface, similar to the socket 206 of the right stub shaft, which receives a convex surface on the right stub shaft, similar in shape to the tip 204 of the cone portion 200, i.e., the positions of the two shapes are reversed.

The linkage provided by the nut and cone assembly 180 is important for several reasons. First, it allows the weight of the print head 18 to rotate the link until the right stub shaft 62 is seated in a right hand X-axis bearing 210 (FIG. 13). Without this, the normal force between the nut and cone assembly 180 and the print head, due to the bias spring 132, and the resulting friction, could prevent seating of the stub shaft in the bearing 210. Second, it accommodates misalignment between the lead screw 172 and the stub shaft socket 206. This avoids undue pressure on the lead screw which may occur from a rigid connection. Third, the linkage accommodates misalignment due to lead screw radial run out.

Thus, unlike prior printer drives, the illustrated lead screw 172 is not rigidly coupled to the right stub shaft 62. The flexible coupling 180 of the present stub shaft 62 to the lead screw accommodates any slight misalignment between the lead screw and the X-axis, as defined by the stub shafts 60, 62. However, it is contemplated that a rigid coupling may alternatively be employed.

The force of the bias spring 132 reduces backlash in the print head drive mechanism 20 by compressing gaps between the stub shaft socket 206 and cone tip 204, the nut portion 184 and the lead screw threads 186, as well as augmenting the preload to a thrust bearing (not shown) of the motor 170.

Since the lead screw 172 is not coupled to the stub shaft 62 for reverse movement in the X-axis, it acts as a pusher drive only. Specifically, the cone and nut assembly 184 only pushes the print head 18 in the driving direction (right to left in the illustrated embodiment). The bias of the spring 132 is thus the return force for print head movements opposite to the drive direction (left to right).

Figure 16:
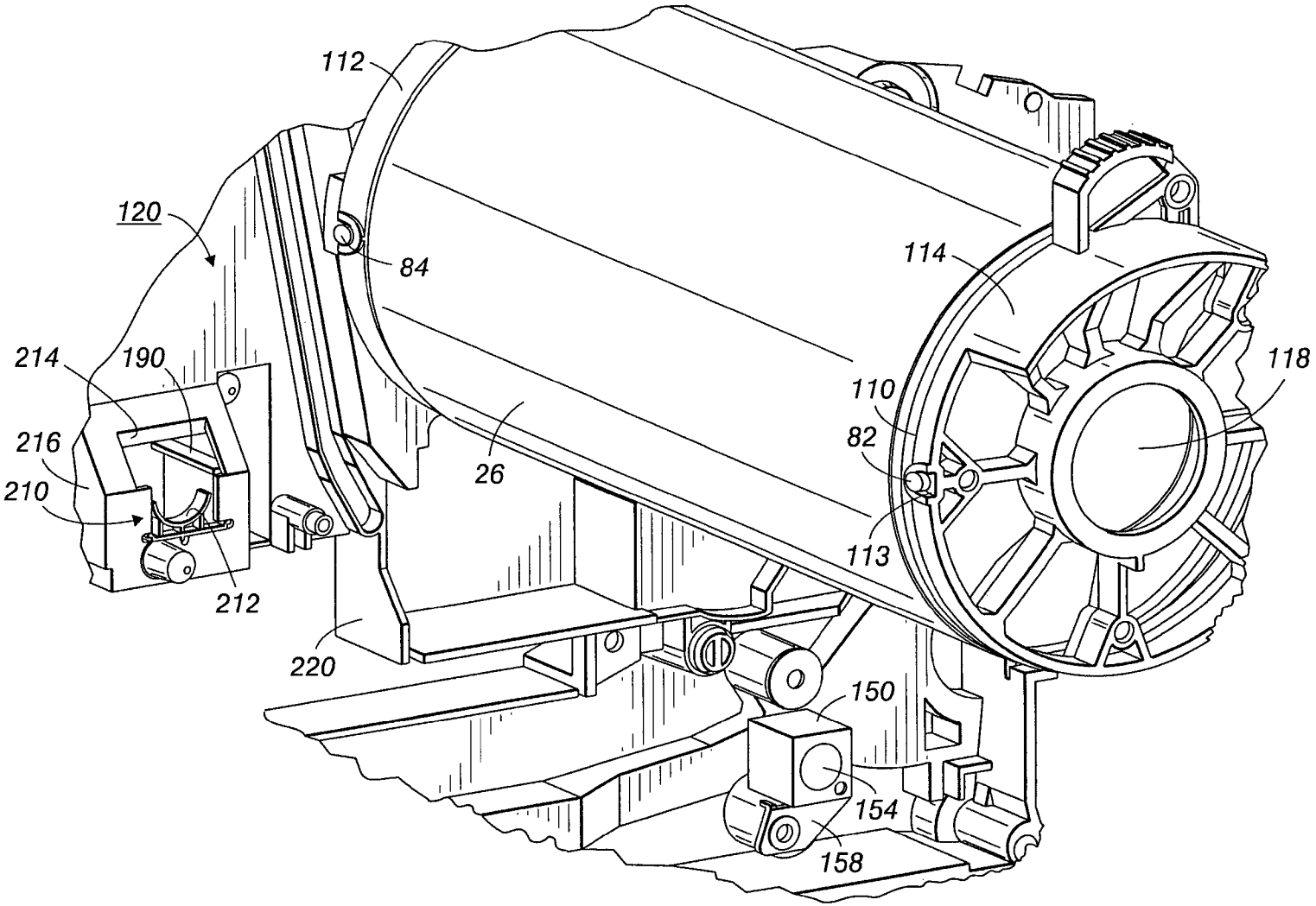
FIG. 16 is a perspective view of the drum, chassis, and right hand print head bearing of the printing apparatus of FIG. 1.

The right stub shaft 62 is constrained against unwanted movement in the X-axis and Y axis. In the X-direction, the print head drive mechanism 20 and the bias spring 132 control the alignment of the print head. In the Y-direction, the weight of the print head 18 holds the right stub shaft 62 in contact with the right bearing 210, illustrated in FIG. 4. As shown in FIG. 16, the bearing 210 is mounted to a portion of the chassis 120 (and hence connected with the linkage 122). The right bearing 210 defines a curved upper surface 212 which is shaped to receive the stub shaft 62 therein. The curvature of the upper surface 212 can be slightly less than that of the stub shaft 62 such that the constraint provided by the bearing 210 is in the Z direction as well as the Y direction.

A keeper (not shown), mounted to a bearing housing 216 constrains the stub shaft 62 against gross upward movement, for example, during transportation of the printer, or when the printer is tipped out of its ordinary horizontal alignment.

The position of the bias spring 132, coaxial with the stub shafts 60, 62, minimizes rotational motions induced in the print head 18. This allows the forward center of gravity of the print head and reservoir 40, along with the head tilt spring(s) 70 to cause rotation of the head about the right stub shaft 62 and sliding of the roll block 150 against the left bearing 158 until contact between both left and right labyrinth seal buttons 82, 84 and hard stops 78, 80 is made, thus achieving proper head alignment.

Features of the print head 18 and the drum assembly 38 define datums that fully constrain the position of the print head without over constraining it. The six degrees of freedom for the print head body are controlled as follows: The first two degrees of freedom are constrained in that two points of contact are defined by the buttons 82, 84 and the hard stops 78, 80 on the left and right sides of the print head, each point provides a single axis of constraint in the Z axis only. The next three degrees of freedom are constrained in that a third point, defined by the position of the right stub shaft 62, is constrained in the Z and Y axis by the right bearing 210 and in the X axis by the X-axis nut/cone and bias spring 132. The final degree of freedom is constrained in that a fourth point is created by the left bearing 60, which is constrained in the Y-axis only, it prevents rotation of the print head about the print head Z-axis.

Tight tolerances between the drum 26 and the labyrinth seal buttons 82, 84 are attained by post machining the buttons, relative to the sockets 113. The diameter of the drum transfer surface 34 is also machined with tight tolerances. The tolerance between the drum labyrinth seals 114, 116 and the X-axis bearings 158, 210 of the print head is controlled by side frames 220 of the chassis, only one of which is illustrated in FIG. 16. In practice, the most difficult tolerance to control can be the parallelism of each of the chassis side frames. This parallelism only affects roll, which is compensated for by selecting an appropriate orientation of the roll adjustment block 150, as described above.

With reference now to FIGS. 3 and 4, tight tolerances are created between the jetstack 32, the hard stops 78, 80, and the x-axis stub shafts 60, 62. This is achieved by placing alignment features on the jetstack 32 and on the front reservoir plate 90 of the print head. In particular, the front reservoir plate 90 includes several alignment pins 230 (three in the illustrated embodiment of FIG. 4), which extend forwardly and are received through corresponding holes 232, 234 in the jetstack (FIG. 3). At least one of the holes 232 is oriented with its major dimension in a generally horizontal direction, while at least another of the holes 234 is oriented with its major dimension in a generally vertical direction. In both cases, the minor dimension of the hole is selected such that the respective pin 230 fits snugly in the hole, with a minimum of play.

The front reservoir plate 90 further includes a plurality of posts 240 (FIG. 5). The posts each have a distal end surface, machined flat, which engages a rear surface 242 of the jetstack, as illustrated in FIG. 2. To lower the tolerance that the thickness of the jetstack 32 contributes to head-to-drum distance, notches 243 may be formed in the jetstack around the posts 240 such that only selected ones of the posts are used. As shown in FIG. 3, a retaining plate or drip plate 244, in cooperation with clips 246, holds the jets stack 32 firmly against the posts. Specifically, the retaining plate 244 includes a plurality of holes 248 for receiving studs 250 therethrough which screw into corresponding bosses 252 in the front reservoir plate 90 (FIG. 4). The posts 240 and bosses 252 serve as spacers between the jetstack 32 and the reservoir plate 90. The clips 246 clamp an upper end of the jetstack against the reservoir plate 90.

In one embodiment, an assembly 254 comprising the reservoir plate 90 (including the alignment pins 230, bosses 252, posts 240, extension members, and left and right hard stops), and left and right stub shafts 60, 62, and left and right mounting towers 64, 66, is integrally formed of one piece, such as by molding, followed by any machining appropriate. Alternatively, the stub shafts 60, 62 may be separately formed and then rigidly attached to the towers 64, 66.

The alignment system 50 thus described maintains alignment of the print head 18 with the drum 26 throughout the printer lifetime, even where slight changes due to wear, warping, or thermal expansion/contraction of the chassis occur.

The three key alignment tolerance parameters which affect print quality are all taken into consideration by the alignment system 50. Head-to-Drum distance is controlled by the interface between the hard stops 78, 80 and the jetstack 32 and between the drum 26 and the labyrinth seal buttons 82, 84. The gap across the entire length of the jetstack between the right and left hard stops is thus maintained within tight tolerances, minimizing HTD skew or yaw. The alignment system also provides stability of the tolerance during shipping and handling. Head height is controlled with the X-axis stub shaft interface by maintaining a tight tolerance between the jet array and the print head X-axis and between the drum labyrinth seals 114, 116 and the X-axis bearings 158, 210. The left side X-axis stub shaft 60 is free to move fore and aft. Pitch and Height, or Hilt, are thus minimized.

Head Roll is the only alignment parameter that is adjusted. This is accomplished using the roll block 150 with the eccentric bore 154. Typically, once the block adjustment has been made at the factory, no further adjustments of the block are necessary during the lifetime of the printer.

The alignment system enables the print head 18 to be accurately aligned with the drum 26 which avoids the need for subsequent print head adjustments, reduces the extent of engine adjustments, and minimizes the risk of print head damage to the drum.

The exemplary drive system 20 is formed with fewer components, reducing the effects of stacked tolerances. The exemplary drive system also allows movement of the print head 18 relative to the drive system in order for the print head to maintain alignment with the transfer surface 34.

While the embodiments have been described with particular reference to printers, it will be appreciated that there are other applications for the alignment system described, including, but not limited to other imaging devices, such as fax machines, copiers, scanners, and the like.

Without intending to limit the scope of the invention, the following example demonstrates the accuracy of the positioning system.

EXAMPLE

The performance of a printer formed as described above and illustrated in the drawings was evaluated by measurement of position versus time using a laser interferometer. Harmonic excursion errors were less than ±2.5 μm. Full scale motion errors were measured by scanning the printed images made by a population of 120 printers. Across the 4 mm travel range, the drive yielded errors of less than ±10 μm (i.e., ±3 standard deviations). Hysteresis errors, also measured with laser interferometer, were less than 15 μm. Hysteresis error is dominated by the clearance between the nut guide slot 192 and the chassis guide rib 190. Because the image process is unidirectional, the magnitude of this error has not been a concern.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof. The recited order of processing elements or sequences, or the use of numbers, letters, or other designations therefore, is not intended to limit the claimed process to any order except as specified in the claim itself.

The invention claimed is:

1. A drive system for driving a driven member comprising:

a motor; and a pivotable linkage which allows relative pivoting between the driven member and the drive system, the pivotable linkage being operatively connected with the motor for advancing the driven member, the pivotable linkage including a drive member, the drive system further including a lead screw, a lead screw operatively connected with the motor, the motor imparting a rotational movement to a lead screw; the drive member being operatively connected with the lead screw such that the drive member advances in response to rotational movement of the lead screw in a first rotational direction.

2. The drive system of claim 1, wherein at least one of the drive member and the driven member defines a socket which receives a tip of the other of the drive member and driven member, allowing pivoting of the drive member relative to the driven member.

3. The drive system of claim 2, wherein the drive member defines the tip.

4. The drive system of claim 1, wherein the drive system is configured for advancing the driven member only in a first axial direction, advancement in a direction opposite to the first axial direction being provided by a biasing assembly.

5. The drive system of claim 1, wherein the drive member includes internal threads which engage external threads on the lead screw.

6. The drive system of claim 5, wherein the internal threads of the drive member are configured to allow pivoting of the drive member relative to the lead screw.

7. The drive system of claim 1, wherein the motor comprises a stepper motor.

8. The drive system of claim 1, wherein the motor is directly connected with the lead screw.

9. A print engine comprising the drive system of claim 1.

10. The print engine of claim 9, wherein the driven member comprises a print head.

11. The print engine of claim 10, wherein the drive system is configured for advancing the print head only in a first axial direction, the system further including:

a biasing assembly for biasing the print head in a direction opposite to the first axial direction.

12. An imaging system comprising the drive system of claim 1, wherein the driven member comprises a print head.

13. A print engine comprising: a print head:

a drive system configured for advancing the print head in a first axial direction, comprising:

a motor, and a pivotable linkage which allows relative pivoting between the print head and the drive system, the pivotable linkage being operatively connected with the motor for advancing the print head;

a biasing assembly for biasing the print head in a direction opposite to the first axial direction, the biasing assembly including a spring which is generally coaxially aligned with the first axial direction.

14. The drive system of claim 13, wherein the pivotable linkage includes a drive member, the drive system further including a lead screw, a lead screw operatively connected with the motor, the motor imparting a rotational movement to a lead screw; the drive member being operatively connected with the lead screw such that the drive member advances in response to rotational movement of the lead screw in a first rotational direction.

15. A print engine comprising:

a print head;

a drive system; and a pivotable linkage which allows relative pivoting between the print head and the drive system, the pivotable linkage being operatively connected with the drive system for advancing the print head, the pivotable linkage including a drive member, at least one of the drive member and the print head defining a socket which receives a tip of the other of the drive member and print head, allowing pivoting of the drive member relative to the print head.

16. The print engine of claim 15, wherein the print head includes a shaft which defines the socket and wherein the drive member defines the tip which is shaped to be received by the socket, the drive member being pivotable, about the tip, relative to the print head.

17. A print engine comprising:

a print head including first and second shafts at first and second ends thereof which define an axis of translation;

a drive system operatively connected with the first shaft; and a pivotable linkage which allows relative pivoting between the print head and the drive system, the pivotable linkage being operatively connected with the drive system for advancing the print head.

18. The print engine of claim 17, further including:

a first X-axis bearing member which receives the first shaft; and a second X-axis bearing member which supports the second shaft for sliding movement relative thereto as the print head is translated in the first axial direction direction.

19. The print engine of claim 18, further including a roll block, mounted on the first shaft, which allows a distance of the first shaft from the second X-axis bearing to be adjusted.

20. An imaging system comprising:

a drive system for driving a print head comprising:

a motor; and a pivotable linkage which allows relative pivoting between the print head and the drive system, the pivotable linkage being operatively connected with the motor for advancing the print head;

a drum assembly, the print head translating relative to the drum assembly during an imaging process, the system further including a biasing member which biases the print head toward the drum assembly, such that, during translation of the print head relative to the drum assembly, a first contacting member on the print head maintains a sliding contact with a first receiving member associated with the drum assembly.

21. A print engine comprising:

a print head which ejects ink;

a drive system for translating the print head in a first axial direction as the print head ejects ink, the drive system being coupled to the print head by a pivotable linkage which allows pivoting between the print head and the drive system.

22. The print engine of claim 21, wherein the pivotable linkage includes:

a drive member and wherein the drive system further includes:

a lead screw, the drive member converting rotational movement of the lead screw into axial movement.

23. A method of driving a print head during an imaging process comprising:

translating the print head during the imaging process in a first axial direction with a drive system, the drive system including a flexible coupling which allows relative pivoting between the print head and the drive system; and ejecting ink from the print head as the print head translates.

24. The method of claim 23, wherein the step of translating includes translating the print head with a drive mechanism which is configured for translating the print head only in a first direction; and biasing the print head in a direction opposite to the first direction.

* * * * *